US008997345B2

(12) United States Patent
Liu

(10) Patent No.: US 8,997,345 B2
(45) Date of Patent: Apr. 7, 2015

(54) EMI-PREVENTING SOCKET AND MANUFACTURING METHOD THEREOF

(75) Inventor: Gang Liu, Shanghai (CN)

(73) Assignees: Delta Electronics (Shanghai) Co., Ltd., Shanghai (CN); Delta Electronics, Inc., Taoyuan Hsien (TW)

( * ) Notice: Subject to any disclaimer, the term of this patent is extended or adjusted under 35 U.S.C. 154(b) by 96 days.

(21) Appl. No.: 13/355,305

(22) Filed: Jan. 20, 2012

(65) Prior Publication Data

US 2013/0017724 A1 Jan. 17, 2013

(30) Foreign Application Priority Data

Jul. 13, 2011 (CN) ..... 2011 1 0196206

(51) Int. Cl.
*H01R 43/24* (2006.01)
*H01R 13/6581* (2011.01)

(52) U.S. Cl.
CPC ..... *H01R 43/24* (2013.01); *H01R 13/6581* (2013.01)

(58) Field of Classification Search
CPC ..... H01R 43/24; H01R 23/6873; H01L 2924/01079; H02G 1/1256; B29C 45/14655
USPC ..... 29/854, 825; 439/607.34; 264/272.14
See application file for complete search history.

(56) References Cited

U.S. PATENT DOCUMENTS 5,835,979 A * 11/1998 Hiraki et al. ..... 174/33
6,042,412 A * 3/2000 Murr ..... 439/331
6,375,476 B1 * 4/2002 Goodwin et al. ..... 439/71
6,558,169 B2 * 5/2003 Figueroa et al. ..... 439/70
6,586,684 B2 * 7/2003 Frutschy et al. ..... 174/260
6,659,512 B1 * 12/2003 Harper et al. ..... 257/777
6,706,562 B2 * 3/2004 Mahajan et al. ..... 438/125
6,929,495 B2 * 8/2005 Ma ..... 439/331
7,083,456 B2 * 8/2006 Trout et al. ..... 439/326
7,170,169 B2 * 1/2007 Trout et al. ..... 257/734
7,375,940 B1 * 5/2008 Bertrand ..... 361/46
7,892,027 B2 * 2/2011 Mao et al. ..... 439/607.25
8,054,639 B2 * 11/2011 Hsu ..... 361/749
8,264,070 B2 * 9/2012 Tsai et al. ..... 257/659
8,362,816 B2 * 1/2013 Ohmine ..... 327/156
8,482,325 B2 * 7/2013 Ohmine ..... 327/156
2006/0220239 A1 * 10/2006 Trout et al. ..... 257/734
2007/0000690 A1 * 1/2007 Chai ..... 174/260
2010/0062653 A1 * 3/2010 Mao et al. ..... 439/660
2010/0134985 A1 * 6/2010 Hsu ..... 361/736
2011/0032690 A1 * 2/2011 Han ..... 361/818
2012/0071022 A1 * 3/2012 Su et al. ..... 439/449
2012/0074538 A1 * 3/2012 Tsai et al. ..... 257/659
2012/0133032 A1 * 5/2012 Tsai et al. ..... 257/659
2012/0318852 A1 * 12/2012 Zhou et al. ..... 228/180.21
2013/0017724 A1 * 1/2013 Liu ..... 439/607.34

* cited by examiner

*Primary Examiner* — David Angwin
(74) *Attorney, Agent, or Firm* — Muncy, Geissler, Olds & Lowe, P.C.

(57) ABSTRACT

A manufacturing method for an EMI-preventing socket comprises the following steps of providing an EMI-preventing element and a plurality of pins, wherein at least one of the pins is a ground pin; connecting the EMI-preventing element to the ground pin via a direct physical connection; providing a mold; placing the EMI-preventing element, the ground pin and the remaining pins of the plurality of pins in the mold, wherein the EMI-preventing element surrounds the pins in the mold; and providing a molding material into the mold to cover the plurality of pins and to cover a joint of the EMI-preventing element and the ground pin to form a socket body of the EMI-preventing socket. Parts of the EMI-preventing element and one end of each of the plurality of pins is exposed out of the socket body of the EMI-preventing socket.

7 Claims, 4 Drawing Sheets

EMI-PREVENTING SOCKET AND MANUFACTURING METHOD THEREOF

CROSS REFERENCE TO RELATED APPLICATIONS

This Non-provisional application claims priority under 35 U.S.C. §119(a) on Patent Application No(s). 201110196206.2 filed in People's Republic of China on Jul. 13, 2011, the entire contents of which are hereby incorporated by reference.

BACKGROUND OF THE INVENTION

1. Field of Invention

The present invention relates to a manufacturing method of a socket and, in particular, to a manufacturing method of an EMI-preventing socket.

2. Related Art

Electromagnetic interference (EMI) may decrease the performance of devices, apparatuses or systems, or cause harmful electromagnetic results which damage lives or inorganic materials. EMI are usually derived from electromagnetic noises, useless signals, or the changes of the transmitting medium itself. If high-frequency wave energy and signal modulation are used, the radiation may be easily leaked from the transmitting medium. To solve the EMI problem, it is usually to configure the conductive fabric, conductive coating, absorbing material, spot soldering, or iron workpiece to generate the grounding conduction to block/isolate the noises generated by the internal components.

FIG. 1 is a schematic diagram showing a conventional power input socket 1. At first, a ground pin 111 and other pins 112 and 113 are placed in a mold (not shown). Then, a molding material B is provided by injection molding to wrap the pins 111, 112 and 113, thereby forming the power input socket 1. In order to prevent the generation of electromagnetic radiation, a conductive element 12 is provided to contact and connect to the ground pin 111 by soldering. Thus, the conductive element 12 can be grounded through the ground pin 111. However, the soldering process for connecting the conductive element 12 and the ground pin 111 easily affects the stability of the manufacturing processes and needs longer working time, so it is not suitable for mass production and rework.

Therefore, it is an important subject to provide a manufacturing method of an EMI-preventing socket that can prevent the undesired EMI, improve the manufacturing yield, and sufficiently reduce the manpower cost and working time.

SUMMARY OF THE INVENTION

In view of the foregoing, the present invention is to provide a manufacturing method of an EMI-preventing socket that can effectively prevent the EMI, improve the assembling process, and enhance the production performance.

To achieve the above, one embodiment of the present invention is to provide a manufacturing method for an EMI-preventing socket. The manufacturing method comprises the following steps of: providing an EMI-preventing element and a plurality of pins that comprises a ground pin; connecting a connecting portion of the EMI-preventing element to the ground pin; providing a mold; placing the EMI-preventing element, the ground pin and the other pins in the mold, while the EMI-preventing element surrounds the pins in the mold; and providing a molding material into the mold to wrap the pins and a joint of the connection portion of the EMI-preventing element and the ground pin to form a socket body of the EMI-preventing socket, wherein parts of the EMI-preventing element and one ends of the pins are exposed out of the socket body of the EMI-preventing socket.

In one preferred embodiment of the present invention, after the step of forming the socket body of the EMI-preventing socket, the manufacturing method further comprises a step of solidifying the molding material.

In one preferred embodiment of the present invention, the step of connecting the EMI-preventing element to the ground pin is to connect the EMI-preventing element with the ground pin by riveting, clipping, contacting, or other well-know sills.

In one preferred embodiment of the present invention, the step of providing the molding material to form the socket body of the EMI-preventing socket is performed by casting molding or injection molding.

In one preferred embodiment of the present invention, the pins comprise a ground pin, a firewire pin, and a neutral pin.

To achieve the above, one embodiment of the present invention also discloses an EMI-preventing socket comprising an EMI-preventing element, a plurality of pins and a socket body. The EMI-preventing element has at least one connecting portion, the pins at least comprise a ground pin, and the connecting portion of the EMI-preventing element and the ground pin are connected securely. The socket body wraps the pins and a joint of the connection portion of the EMI-preventing element and the ground pin.

In one preferred embodiment of the present invention, the pins comprise a ground pin, a firewire pin, and a neutral pin.

As mentioned above, the manufacturing method of the present invention is to connect the EMI-preventing element with the ground pin in advance by, for example, riveting, and then form the socket body of the EMI-preventing socket by injection molding. In other words, the EMI-preventing element and the ground pin are connected before injecting the molding material. This procedure can firmly connect the EMI-preventing element with the ground pin. After the following molding step, the manufactured product can effectively prevent the undesired EMI, increase the production yield, and reduce the manufacturing time. Besides, the manufacturing method of the present invention does not use a soldering process to connect the EMI-preventing element with the ground pin, so that it can reduce manpower cost and working time and be more environmentally friendly.

BRIEF DESCRIPTION OF THF DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
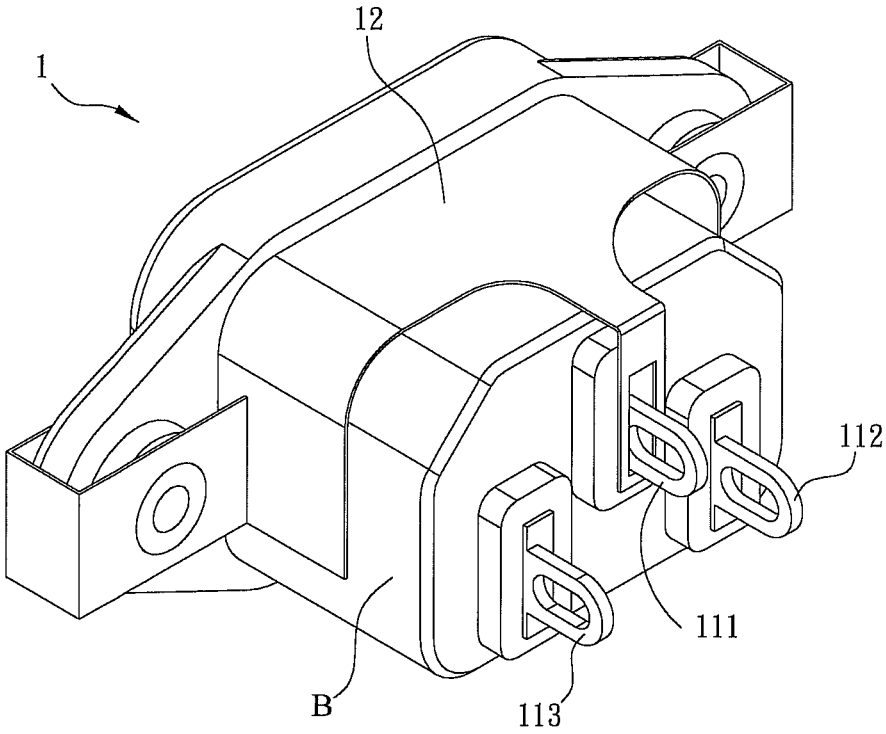
FIG. 1(Prior Art)
FIG. 1 is a schematic diagram showing a conventional power input socket.
Figure 2:
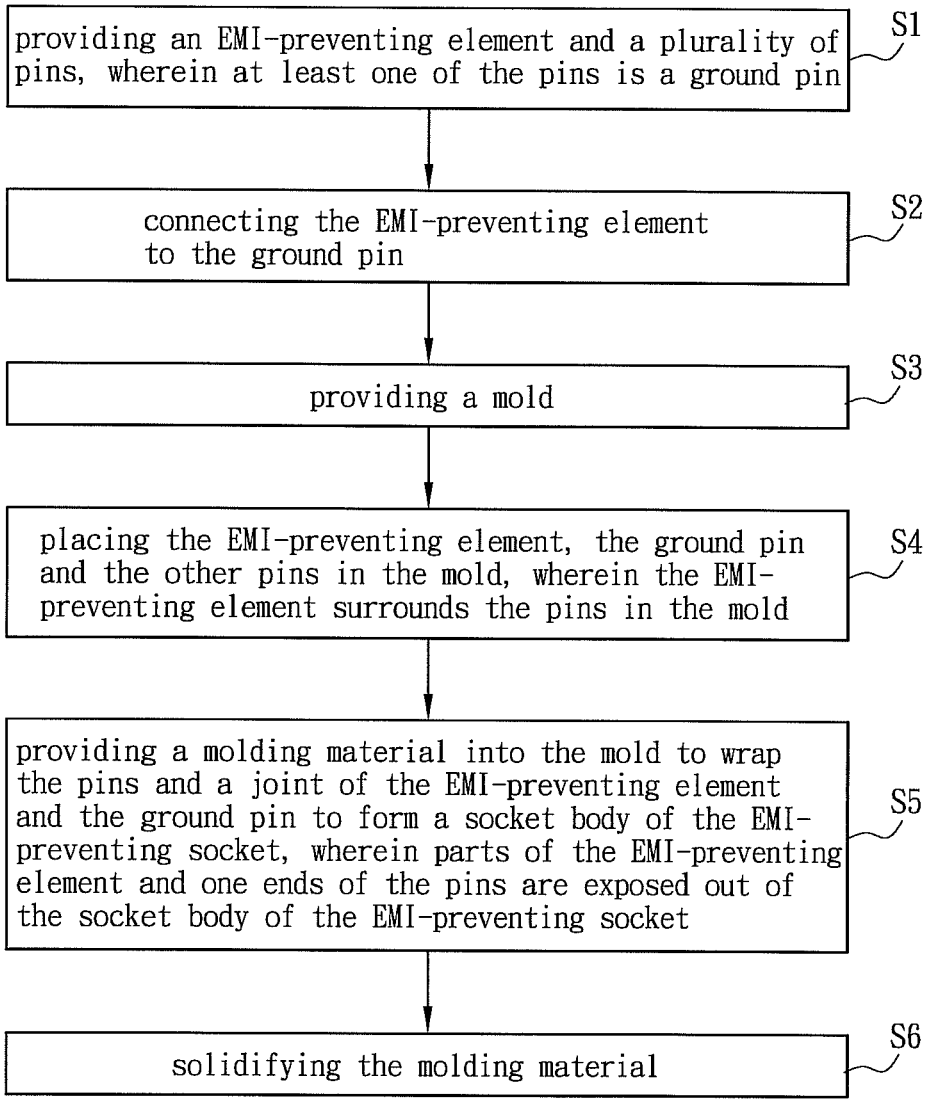
FIG. 2 is a flow chart of a manufacturing method of an EMI-preventing socket according to a preferred embodiment of the present invention.
Figure 3:
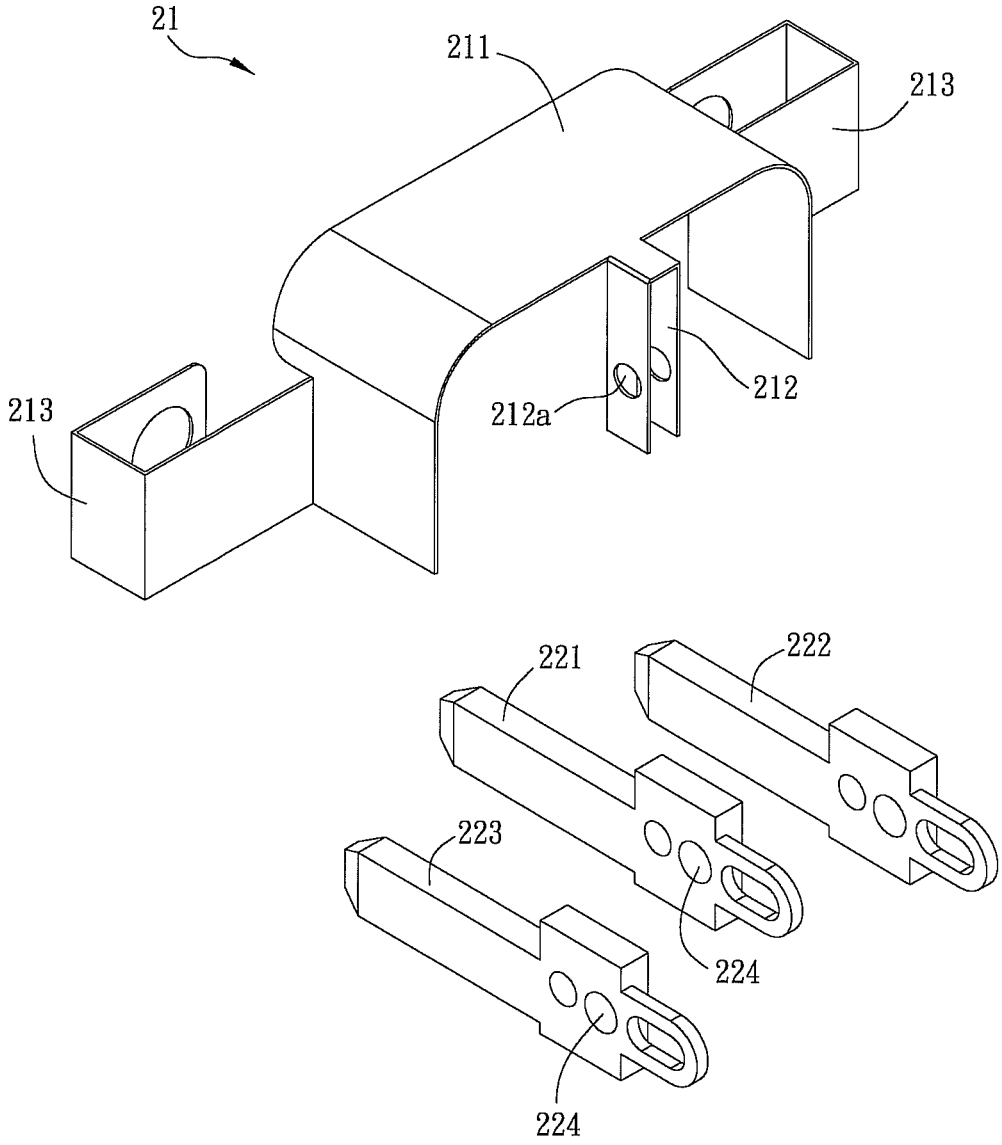
FIGS. 3 and 4 are schematic diagrams showing the EMI-preventing socket during the manufacturing processes according to a preferred embodiment of the present invention.

FIG. 2 is a flow chart of a manufacturing method of an EMI-preventing socket according to a preferred embodiment of the present invention, and FIG. 3 is a schematic diagram showing the EMI-preventing socket during the manufacturing processes. Referring to FIGS. 2 and 3, the EMI-preventing socket of the present embodiment is, for example, a three-hole socket that is suitable for home appliances and factory machines. Of course, the manufacturing method of the invention can also be applied to fabricate other sockets with EMI-preventing function.

At first, a step S1 is to provide an EMI-preventing element 21 and a plurality of pins 221, 222 and 223. Herein, the pin 221 is a ground pin. The EMI-preventing element 21 is made of electrically conductive material, for example, metal. Alternatively, if the EMI-preventing element is made of non-conductive material, it is preferably to dispose a conductively metallic layer on the EMI-preventing element. As shown in FIG. 3, the EMI-preventing element 21 comprises a frame 211, two connecting portions 212 and two clipping portions 213. The clipping portions 213 are disposed at two opposite sides of the frame 211 and protruded from the frame 211. The connecting portions 212 are disposed at the center of the frame 211, and each of them includes a connecting hole 212*a*. The connecting holes 212*a* are positioned opposite to each other. To be noted, the shape and appearance of the EMI-preventing element 21 disclosed hereinabove is not to limit the scope of the present invention, but depends on the design purpose according to the desired functions and operations.

In this embodiment, the pin 221 is a ground pin, the pin 222 is a firewire pin, and the pin 223 is a neutral pin. The ground pin 221 is disposed between the connecting portions 212 of the EMI-preventing element 21. Each of the pins 221-223 has at least one through hole 224. In this embodiment, each of the pins 221-223 has several through holes 224. The functions of the through holes 224 will be described hereinafter.

Next, a step S2 is to connect the connecting portions 212 of the EMI-preventing element 21 to the ground pin 221. The EMI-preventing element 21 and the ground pin 221 are connected by riveting, clipping, or directly contacting without any other objects or elements. Since the connecting portions 212 and the ground pin 221 are connected, the EMI-preventing element 21 and the ground pin 221 are connected accordingly. In this embodiment, the connecting portion 212 of the EMI-preventing element 21 and the ground pin 221 are connected by riveting. In more detail, a rivet (not shown) is provided passing through the ground pin 221 and the connecting holes 212*a* of the connecting portions 212 of the EMI-preventing element 21 and the protrusion part of the rivet is punched to form a rivet head, thereby finishing this connecting process.

A step S3 is to provide a mold (not shown). In this embodiment, the mold is configured to accommodate the EMI-preventing element 21 and the pins 221-223. Thus, the space inside the mold should be larger than the total volume of the EMI-preventing element 21 and the pins 221-223. The mold can be made of any useable material well-known in the field, which is not described here.

Then, a step S4 is to place the EMI-preventing element 21 as well as the connected ground pin 221 and the other pins 222 and 223 in the mold, while the frame 211 of the EMI-preventing element 21 surrounds the pins 221-223 in the mold. To be noted, when the pins 221-223 and the EMI-preventing element 21 are placed in the mold, only the ground pin 221 is connected to the EMI-preventing element 21, and the other two pins 222 and 223 are individually positioned and separated from EMI-preventing element 21 and the ground pin 221.

Figure 4:
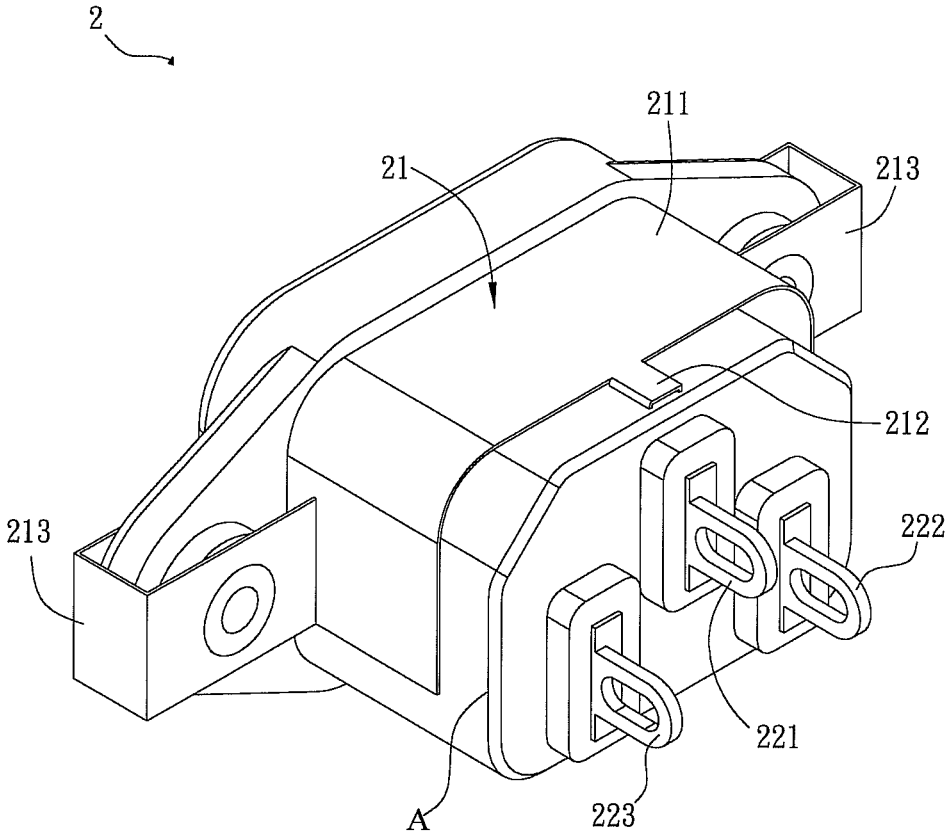

FIG. 4 is a schematic diagram showing the finished EMI-preventing socket 2 according to the preferred embodiment of the present invention. Referring to FIGS. 2 and 4, a step S5 is to provide a molding material into the mold to wrap the pins 221-223 and a joint of the connection portions 212 of the EMI-preventing element 21 and the ground pin 221 to form a socket body A of the EMI-preventing socket 2. In this embodiment, parts of the EMI-preventing element 21 and one ends of the pins 221-223 are exposed out of the socket body A of the EMI-preventing socket 2. Accordingly, the frame 211 and the clipping portions 213 of the EMI-preventing element 21 are appeared on the socket body A. Besides, the EMI-preventing socket can be formed in the step S5 by casting molding or injection molding. In practice, the solid molding material is heated to melting state, and then flows into the mold to fill the through holes 224 of the pins 221-223 and the clipping portions 213 of the EMI-preventing element 21. This step S5 can enhance the connection strength between the molding material, the EMI-preventing element 21, and the pins 221-223.

Finally, a step S6 is to solidify the molding material. In this embodiment, the molding material can be solidified by cooling, thereby forming the solid socket body A. In other words, the socket body A is the solidified molding material. Since the molding material is filled between the pins 221-223, the positions of the pins 221-223 can also be fixed after solidifying the molding material, so that the socket body A can cover the pins 221-223. Besides, since the molding material is also filled in the clipping portions 213 of the EMI-preventing element 21 and the connection portions 212 of the EMI-preventing element 21 and the ground pin 221, the positions of the EMI-preventing element 21 and the joint of the connection portions 212 of the EMI-preventing element 21 and the ground pin 221 can be securely fixed after solidifying the molding material.

Referring to FIG. 4 again, the present invention also discloses an EMI-preventing socket 2 including an EMI-preventing element 21, a plurality of pins 221-223 and a socket body A. Please see FIG. 4 in view of FIG. 3 for the following illustration. The EMI-preventing element 21 comprises a frame 211, at least a connecting portion 212 and two clamping portions 213. The clamping portions 213 are disposed at two sides of the frame 211 and protruded from the frame 211. The connecting portion 212 is disposed at the center of the frame 211 and includes a connecting hole 212*a*. In this embodiment, the EMI-preventing element 21 comprises two connecting portions 212, and each connecting portion 212 has a connecting hole 212*a*. The connecting holes 212*a* can be disposed either opposite to each other or not. To be noted, the EMI-preventing element 21 of this embodiment is not to limit the scope of the present invention, and it can be modified according to desired function or operation.

The pins 221-223 can be divided into a ground pin 221, a firewire pin 222 and a neutral pin 223. The ground pin 221 is disposed between the connecting portions 212 of the EMI-preventing element 21. Herein, the connecting portions 212 connect the ground pin 221, so that the EMI-preventing element 21 and the connecting portions 212 are connected. Each of the pins 221-223 has at least one through hole 224. In this embodiment, each of the pins 221-223 has several through holes 224.

The socket body A wraps the pins 221-223 and a joint of the EMI-preventing element 21 and the ground pin 221 as well as the connection portions 212 of the EMI-preventing element 21. In addition, the socket body A may pass through the through holes 224 of the pins 221-223, and be disposed between the clamping portions 223 for fixing the positions of the EMI-preventing element 21 and the pins 221-223. This configuration can further increase the strength of the connections. In this case, the frame 211 and clamping portions 213 of the EMI-preventing element 21 and one ends of the pins 221-223 are exposed from the socket body A.

In summary, the manufacturing method of the present invention is to connect the connecting portion of the EMI-preventing element with the ground pin in advance by, for example, riveting, and then form the EMI-preventing socket by injection molding. In other words, the EMI-preventing element and the ground pin are connected before injecting the molding material. This procedure can firmly connect the EMI-preventing element with the ground pin. After the following molding step, the manufactured product can effectively prevent the undesired EMI, increase the production yield, and reduce the manufacturing time. Besides, the manufacturing method of the present invention does not use a soldering process to connect the EMI-preventing element with the ground pin, so that it can reduce manpower cost and working time and be more environmentally friendly.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A manufacturing method for an EMI-preventing socket, comprising the following steps of:

providing an EMI-preventing element and a plurality of pins, wherein at least one of the pins is a ground pin;

connecting the EMI-preventing element to the ground pin via a direct physical connection;

providing a mold;

placing the EMI-preventing element, the ground pin and the remaining pins of the plurality of pins in the mold, wherein the EMI-preventing element surrounds the pins in the mold; and providing a molding material into the mold to cover the plurality of pins and to cover a joint of the EMI-preventing element and the ground pin to form a socket body of the EMI-preventing socket, wherein parts of the EMI-preventing element and one end of each of the plurality of pins is exposed out of the socket body of the EMI-preventing socket.

2. The manufacturing method of claim 1, wherein after the step of forming the socket body of the EMI-preventing socket, the manufacturing method further comprises a step of:

solidifying the molding material.

3. The manufacturing method of claim 1, wherein the step of connecting the EMI-preventing element to the ground pin is by riveting, clipping, or contacting a connecting portion of the EMI-preventing element with the ground pin.

4. The manufacturing method of claim 1, wherein the step of providing the molding material to form the socket body of the EMI-preventing socket is performed by casting molding or injection molding.

5. The manufacturing method of claim 1, wherein the pins comprises at least one through hole, and the step of providing the molding material to form the socket body of the EMI-preventing socket is to provide the molding material into the through hole.

6. The manufacturing method of claim 1, wherein the pins comprise the ground pin, a firewire pin, and a neutral pin.

7. The manufacturing method of claim 1, wherein the EMI-preventing element is made of electrically conductive material.

* * * * *